US006752179B1

(12) United States Patent
Schwartz

(10) Patent No.: US 6,752,179 B1
(45) Date of Patent: Jun. 22, 2004

(54) SMALL LIQUID SUPPLY ASSEMBLY

(75) Inventor: Thomas W. Schwartz, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 119 days.

(21) Appl. No.: 10/112,182

(22) Filed: Mar. 28, 2002

(51) Int. Cl.[7] ..... B65B 1/04

(52) U.S. Cl. ..... 141/18; 141/2; 141/114; 222/207; 222/215

(58) Field of Search ..... 239/375–379, 239/302; 222/105, 107, 207, 211, 215, 206; 141/2, 18, 114, 313

(56) References Cited

U.S. PATENT DOCUMENTS

| | | | | |
|---|---|---|---|---|
| 3,249,262 A | * | 5/1966 | Barr et al. | 222/630 |
| 3,252,628 A | * | 5/1966 | Broderick et al. | 222/630 |
| 5,582,350 A | | 12/1996 | Kosmyna et al. | |

FOREIGN PATENT DOCUMENTS

| | | |
|---|---|---|
| DE | 2 042 593 | 3/1972 |
| DE | 195 18 843 C1 | 11/1996 |
| EP | 0 733 557 A1 | 9/1996 |
| EP | 0 987 060 | 3/2000 |
| FR | 2 485 954 | 1/1982 |
| WO | WO 98/32539 | 7/1998 |
| WO | WO 01/12337 A1 | 2/2001 |

OTHER PUBLICATIONS

DeVilbiss "Disposable Liner Guidelines", Printed Dec. 1995.

"See–Through Plastic Cans Enliven Paint Packaging", Plastics Technology, Aug. 2001, pp. 45, 47–48.

* cited by examiner

*Primary Examiner*—Steven O. Douglas
(74) *Attorney, Agent, or Firm*—William L. Huebsch

(57) ABSTRACT

Several embodiments of small volume containers for use to feed liquid to a gravity feed liquid spraying device. Each container comprises a body portion having axially spaced first and second ends, means for closing the second end of the body portion, and a first adapter attached to the first end of the body portion. The body portion, means for closing, and first adapter have inner surfaces defining a cavity in the container having a small volume. The adapter comprises an engagement portion having a through opening communicating with the cavity in the body portion, which engagement portion is adapted for liquid and air tight engagement an inlet port of the spraying device. The container includes vacuum restricting means for restricting vacuum within its cavity as liquid moves out of its cavity into a spraying device through the opening in the first adapter with the second end of the container uppermost.

18 Claims, 7 Drawing Sheets

SMALL LIQUID SUPPLY ASSEMBLY

FIELD OF THE INVENTION

The present invention relates to the liquid supply assemblies that supply mixtures of component liquids to be sprayed (e.g., paint) to gravity feed liquid spraying devices such as spray guns.

BACKGROUND OF THE INVENTION

Various liquid supply assemblies have been described for supplying mixtures of component liquids to be sprayed to gravity feed liquid (e.g., paint) spraying devices such as spray guns, including the supply assembly having a collapsible liner that is described in International Publication Number WO 98/32539 of Jul. 30, 1998, the content whereof is incorporated herein by reference, and the improvement in that supply assembly described in U.S. patent application Ser. No. 09/901,410 filed Jul. 9, 2001, the content whereof is also incorporated herein by reference.

The liquid supply assembly described in WO 98/32539 includes a container of stiff polymeric material comprising a side wall and a bottom wall at a bottom end of the side wall with an opposite top end of the side wall defining an opening into a cavity in the container, and a flexible liner within that cavity, which liner corresponds in shape to an inner surface of the container, and has an annular lip along the top end of the side wall that defines an opening into a cavity in the liner. That liquid supply assembly further includes an adapter assembly comprising a central portion having a through opening that is adapted to engage the inlet port of the gravity feed liquid spraying device, a transverse portion including a peripheral part adapted for engagement within the flexible liner adjacent the top end of the container, and means for securing the flexible liner around that peripheral part of the adapter assembly. The flexible liner within the cavity in the container can be used as a receptacle for measuring and mixing two or more component liquids for the mixture to be sprayed, and markings or indicia are provided on the side of the container that enable the volume of the contents of the container to be determined, which can facilitate measuring the needed amounts of those component liquids. After the liquids are mixed the adapter assembly is secured to the flexible liner, the adapter assembly is engaged with the inlet port of the spraying device, the liquid supply assembly is positioned above the spraying device with the bottom wall of the container uppermost, and the spraying device is operated to dispense the liquid mixture from within the flexible liner. The flexible liner collapses as the liquid mixture is dispensed to restrict the formation of a vacuum in the liner.

U.S. patent application Ser. No. 09/901,410 describes a liquid supply assembly for use with gravity feed liquid spraying devices that, like the liquid supply assemblies described in WO 98/32539, provides indicia by which component liquids for mixtures of liquids to be sprayed by such devices are measured to provide predetermined ratios, but which affords conveniently providing indicia that facilitates measuring many more of the different ratios of different component liquids that might be desired by operators of such liquid spraying devices than when such indicia are provided on the containers or mixing cups as described in WO 98/32539 by providing different indicia on a plurality of different indicating sheets of resiliently flexible polymeric material, any one of which sheets can be positioned between the side wall of the container and the flexible liner.

A liquid supply assembly for use with gravity feed liquid spraying devices incorporating features described in WO 98/32539 and in U.S. patent application Ser. No. 09/901,410 is currently being sold by Minnesota Mining and Manufacturing Company under the trade designation "3M (T.M.) Paint Preparation System". That liquid supply assembly is adapted to contain a fairly large amount of liquid (i.e., about 20 fluid ounces or 600 ml) and incorporates several disposable parts that are typically discarded rather than being cleaned after liquid is sprayed from them. While use of that liquid supply assembly is economical when a large surface area is to be sprayed because of the short clean up time afforded by its disposable parts, it becomes less economical when only a small amount of liquid is to be sprayed, such as, for example, when a painter is testing a paint mixture for a color match, or is painting a small surface area, or is spraying a thinned clear coat or blending clear to blend new and old layers of clear coat. Painters reportedly have mounted only the disposable first adapter 40 described in U.S. patent application Ser. No. 90/901,410 in the reusable second adapter 54 on their spray guns (without the container 12, disposable liner 20 and sealing ring 53) with its peripheral part 50 uppermost to contain a small amount of paint to be sprayed for such purposes in the cavity defined by its then upwardly diverging frusto conical upper surface. Such use of the first adapter 40 is difficult, however, in that its peripheral part 50 must be kept generally horizontal to prevent spilling the paint, and even then, the first adapter 40 has a very large opening through which paint can spill if the spray gun or adapter 40 is bumped or moved sideways too suddenly.

DISCLOSURE OF THE INVENTION

The present invention provides an economical and easily usable liquid supply container for a small amount of liquid to be sprayed by a gravity feed spraying device such as a spray gun.

According to the present invention there is provided a small volume container for use to feed liquid to a gravity feed liquid spraying device. The container comprises a body portion having axially spaced first and second ends, means for closing the second end of the body portion, and a first adapter attached to the first end of the body portion. The body portion, means for closing, and first adapter have inner surfaces defining a small volume cavity in the container (i.e., a cavity having a volume in the range of about 0.5 to 5 ounces or 15 to 150 ml). The first adapter comprises an engagement portion having a through opening communicating with the cavity in the body portion, which engagement portion is adapted for liquid and air tight engagement with the spraying device. The container also includes means for restricting the formation of a vacuum in its cavity as liquid moves out of its cavity through the first adapter with the second end of the container uppermost.

The engagement portion of the container according to the present invention can be adapted for engagement with the reusable second adapter 54 that can be attached to a spraying device that is described in U.S. patent application Ser. No. 90/901,410.

In one embodiment of the small volume container the body portion is formed by thin flexible polymeric material, and the container further includes a plurality of stiff rings fixed to and spaced axially along the body portion. That container can be filled with liquid by manually collapsing the body portion of the container between the rings to decrease the size of the cavity in the container, immersing an end portion of a transfer pipette engaged with the inner surface of the engagement portion of the first adapter in the liquid, and pulling the second end of the body portion away from its first end to expand the volume of the cavity in the container so that atmospheric pressure pushes liquid into that cavity through the pipette. The body portion is again collapsible between the rings to afford movement of the rings to positions closely adjacent to each other to decrease the volume of the cavity as liquid in the container moves through the opening in the first adapter into a spraying device, thereby providing the means for restricting vacuum in the cavity.

In another embodiment of the small volume container the body portion is formed by thin flexible polymeric material, and the container further includes a fastener closing the second end of the body portion, which fastener is separable to open the second end of the body portion and facilitate filing the container with liquid through the second end of the body portion. The body portion is collapsible as liquid in the container moves through the opening in the first adapter to provide the means for restricting vacuum in the cavity.

In another embodiment of the small volume container the body portion comprises a stiff body part having an first end defining the first end of the body portion and an opposite second end, and a flexible part formed by thin flexible polymeric material extending from the second end of the stiff body part and defining the second end of the body portion. The adapter includes a cap-like portion fixed to the end of the engagement portion adjacent the body portion, which cap-like portion releasably engages the first end of the stiff body member in liquid tight engagement, and is separable from the stiff body part to open the first end of the body portion and facilitate filing the cavity with liquid through that first end. The flexible part of the body portion is collapsible as liquid in the container moves through the opening in the first adapter to provide the means for restricting vacuum in the cavity.

In another embodiment of the small volume container the body portion is formed of stiff resiliently flexible polymeric material that upon being collapsed by application of outside force and then released will return to its original shape. The container is capable of being filled with liquid by manually collapsing the container, immersing an end portion of a transfer pipette engaged with the inner surface of the engagement portion of the first adapter in the liquid, and allowing the container to return to its original shape to expand the volume of the cavity in the container so that atmospheric pressure pushes liquid into that cavity through the pipette. The body portion of the container is again collapsible as liquid in the container moves through the opening in the first adapter into the spray gun to provide the means for restricting vacuum in the cavity.

In another embodiment of the small volume container the elongate body portion is formed of stiff polymeric material and has an annular lip at its second end. The means for closing the second end of the body portion is a cap releasably engaging the second end of the body portion, which cap is separable from the body portion to thereby open the second end of the body portion and facilitate filing the cavity with liquid through that second end. The means for restricting vacuum in the cavity can be provided by loosening the cap when the liquid is being sprayed, or by providing a vent opening in the cap.

In another embodiment of the small volume container the body portion and the adapter are provided by the disposable first adapter 40 described in U.S. patent application Ser. No. 90/901,410 (without the container 12, disposable liner 20 and sealing ring 53) including its peripheral part 50 which, as discussed above can contain a small amount of liquid to be sprayed in the cavity defined by its diverging frusto conical inner surface and its peripheral part 50. The means for closing the second end of the body portion is a cover (i.e., a polymeric cover of the type used to close opened cans of coffee) that releasably engages the outer surface of that peripheral part 50. That cover also has or can be provided with a vent opening into the cavity to provide the means for restricting vacuum in the cavity.

The embodiments of the small volume container described herein are of a sufficiently inexpensive structure that they can be disposed of after a single use, however, certain of the embodiments could be cleaned and re-used if that was desired.

DESCRIPTION OF DRAWING

The present invention will be further described with reference to the accompanying drawing wherein like reference numerals refer to like parts in the several views, and wherein.

DETAILED DESCRIPTION OF THE INVENTION

Figure 1:
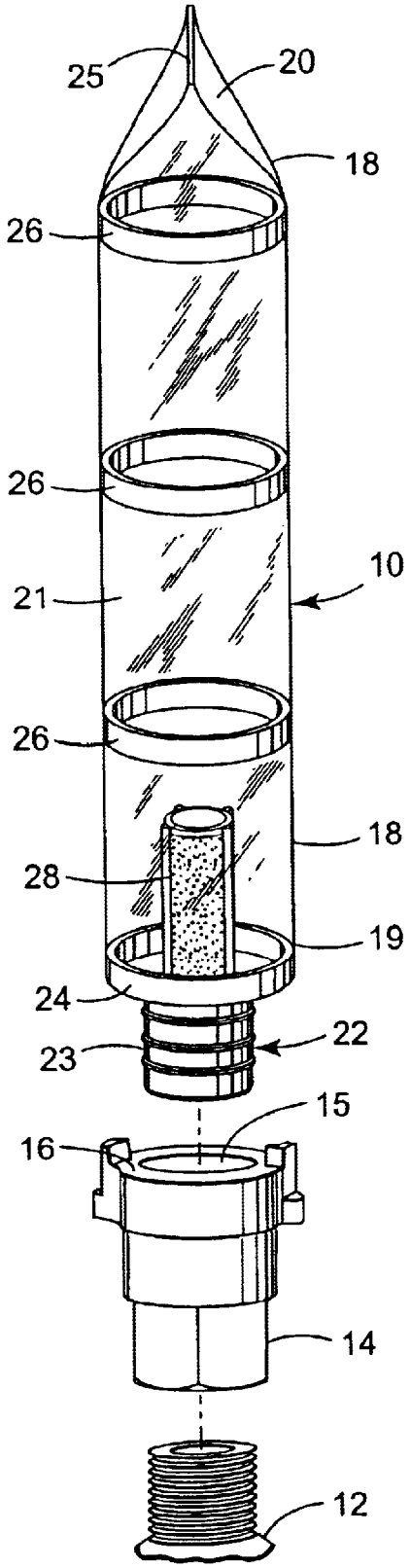
FIG. 1 is an exploded perspective view of a first embodiment of a small volume container according to the present invention shown in its normal expanded condition together with a second adapter with which it can be engaged and a fragment of a spraying device on which the second adapter can be mounted.
Figure 2A:
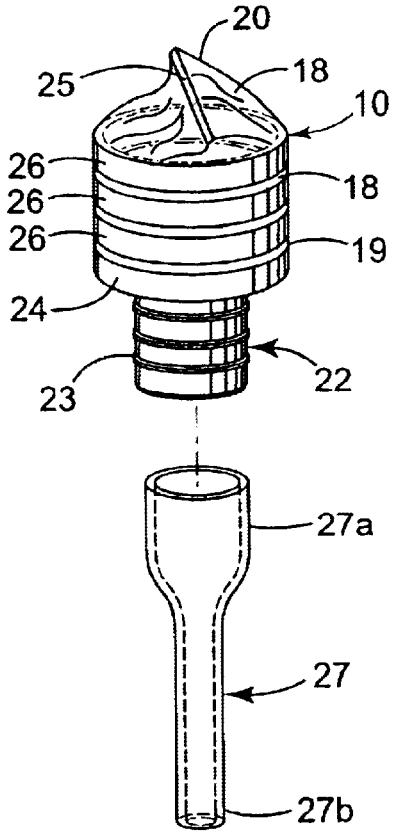
FIG. 2*a* is a perspective view of the small volume container of FIG. 1 shown in a collapsed condition in which it can be positioned, together with a transfer pipette that can be used with the small volume container.

Referring now to FIGS. 1 and 2*a* of the drawing there is illustrated a first embodiment of a disposable small volume container 10 according to the present invention that can be used to feed liquid to a gravity feed liquid spraying device such as a spray gun 12 (e.g., the spray gun commercially designated NR 95 that is available from Sata, Farbspritzechnik GmbH & Co., Kornwestheim, Germany). Only a fragment including a liquid inlet port of the spraying device 12 is shown. A reusable metal adapter 14 can be mounted by threaded engagement on the liquid inlet port of the gravity feed spraying device 12 with a through passageway 15 in the adapter 14 communicating with the inlet port and opening through its distal end 16 for receiving liquid to be sprayed by the spraying device 12. That reusable adapter 14 has essentially the same structure as the reusable adapter 54 described in U.S. patent application Ser. No. 90/901,410, the content of which application is incorporated herein by reference. That passageway 15 in the adapter is partially defined by a cylindrical inner surface of a predetermined diameter adjacent the distal end 16 of the adapter 14.

The small volume container 10 comprises an elongate generally tubular body portion 18 made of thin, very flexible, transparent, paint solvent resistant polymeric film material (e.g., the film that can be heat sealed to itself or to a polyethylene substrate commercially available from Minnesota Mining and Manufacturing Company (3M), St. Paul, Minn. under the trade designation ET29905 "SCOTCHPAK (T.M.) Film"). The body portion 18 has axially spaced first and second ends 19 and 20. The first end 19 of the body portion 18 is attached (i.e., by heat sealing) around a cylindrical lip 24 on a first adapter 22. Means in the form of a transverse heat seal 25 sealing together opposite sides of the body portion 18 are provided for closing the second end 20 of the body portion 18. The inner surfaces of the body portion 18, first adapter 22, and the heat seal 25 define a cavity 21 in the container 10. The first adapter 22 comprises an axially projecting engagement portion 23 having a through opening communicating with the cavity 21 in the container 10. The engagement portion 23 has a cylindrical periphery with axially spaced radially outwardly projecting annular ridges adapted for liquid and airtight engagement with the cylindrical inner surface of passageway 15 in the reusable adapter 14 when the engagement portion 23 is manually pressed into the passageway 15. The small volume container 10 further includes a plurality of stiff annular rings 26 of polymeric material fixed to (e.g., by heat sealing) and spaced axially along the inner surface of the body portion 18. Three rings 26 are illustrated, however more or less could be used depending on the length of the container 10. The cavity 21 in the small volume container 10 can be filled with liquid by manually collapsing the body portion 18 of the container between the rings 26 (i.e., moving the rings 26 together along the axis of the container 10) to the positions shown in FIG. 2*a*, engaging an end portion 27*a* of a polymeric transfer pipette 27 shown in FIG. 2*a* with the inner surface of the engagement portion 23, immersing a distal end portion 27*b* of the transfer pipette 27 in the liquid, and pulling the second end 20 of the body portion 18 away from its first end 19 to cause the cavity 21 to expand in volume and cause atmospheric pressure to push liquid through the pipette 27 into the cavity 21 in the container 10. The pipette 27 is then removed and the engagement portion 23 of the first adapter 22 can then be manually pressed into the passageway 15 in the reusable adapter 14 with the spraying device 12 inverted, after which the spraying device 12 can be moved to its normal position with the body portion 18 projecting above the spraying device 12 with its second end 20 uppermost. As liquid from the container 10 is dispensed through the spraying device 12, the body portion 18 again collapses between the rings 26 so that the rings 26 move toward positions closely adjacent each other to decrease the volume of the cavity 21 in the container 10 (see FIG. 2). This ability of the cavity 21 to decrease in volume provides for the container 10 vacuum restricting means for allowing liquid within its cavity 21 to move through the through opening in the first adapter 22 with the second end 20 of the body portion 18 uppermost without causing a vacuum in the cavity 21 that can restrict the proper flow of liquid from the container 10 into the gravity feed spraying device 12.

The transfer pipette 27 is a resiliently flexible thin wall polymeric tube having at one end the cylindrical end portion 27*a* (e.g., 0.5 inch or 1.3 cm outside diameter) that has an outer surface adapted for frictional sealing engagement with the cylindrical inner surface of the engagement portion 23 of the adapter, an inner diameter at its distal end portion 27*b* of about 0.28 inch or 0.7 cm, and an overall length of about 1.5 inches or 3.8 cm. A suitable transfer pipette can be formed by cutting off about 1.2 inch or 3 cm from the end of the bulb and about 3.5 inches or 9 cm from the end opposite the bulb of the transfer pipette commercially designated a SAMCO (t.m.) transfer pipette, catalog no. 202, available from Samco Scientific Corp., San Fernando, Calif.

The small volume container 10, as illustrated, can optionally include a removable paint filter assembly 28 of a known commercially available type (e.g., the filter assembly commercially available from Filtertek, Hebron, Ill.) which has the same structure as the filter assembly 82 described in more detail in U.S. patent application Ser. No. 90/901,410 (the content of which is incorporated herein by reference). An annular end portion of the paint filter assembly 28 is frictionally engaged with the inner surface of the engagement portion 23 after the container 10 is filled with liquid through the pipette 27.

Figure 2B:
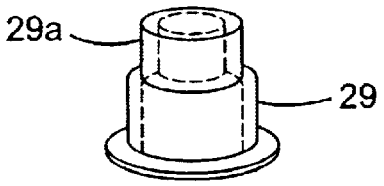
FIG. 2*b* is a perspective view of a plug that can be used with the small volume container.

An injection molded resiliently flexile polymeric plug 29 (e.g, having a 0.45 inch or 1.1 cm thick wall of polyethylene) shown in FIG. 2*b* can be provided that has a cylindrical end portion 29*a* adapted to be pressed into frictional engagement with the inner surface of the engagement portion 23 to close the cavity 21 in the container 10. The plug 29 can be useful to store liquid in the container 10 prior to attaching the container 10 to the spraying device 12, or, if not all of the liquid in the container 10 is used by the spraying device 12, to close the container 10 after it is removed from the spraying device 12, thereby allowing the liquid to be stored in the container 10 for disposal or until it is again needed.

As a non-limiting example, the body portion 18 of the container 10 can have a diameter of about 1.2 inches or 3 cm, and a length of about 5.5 inches or 14 cm between its ends 19 and 20 to provide a maximum volume for the cavity 21 of about 2.3 ounces or 70 ml.

Figure 3:
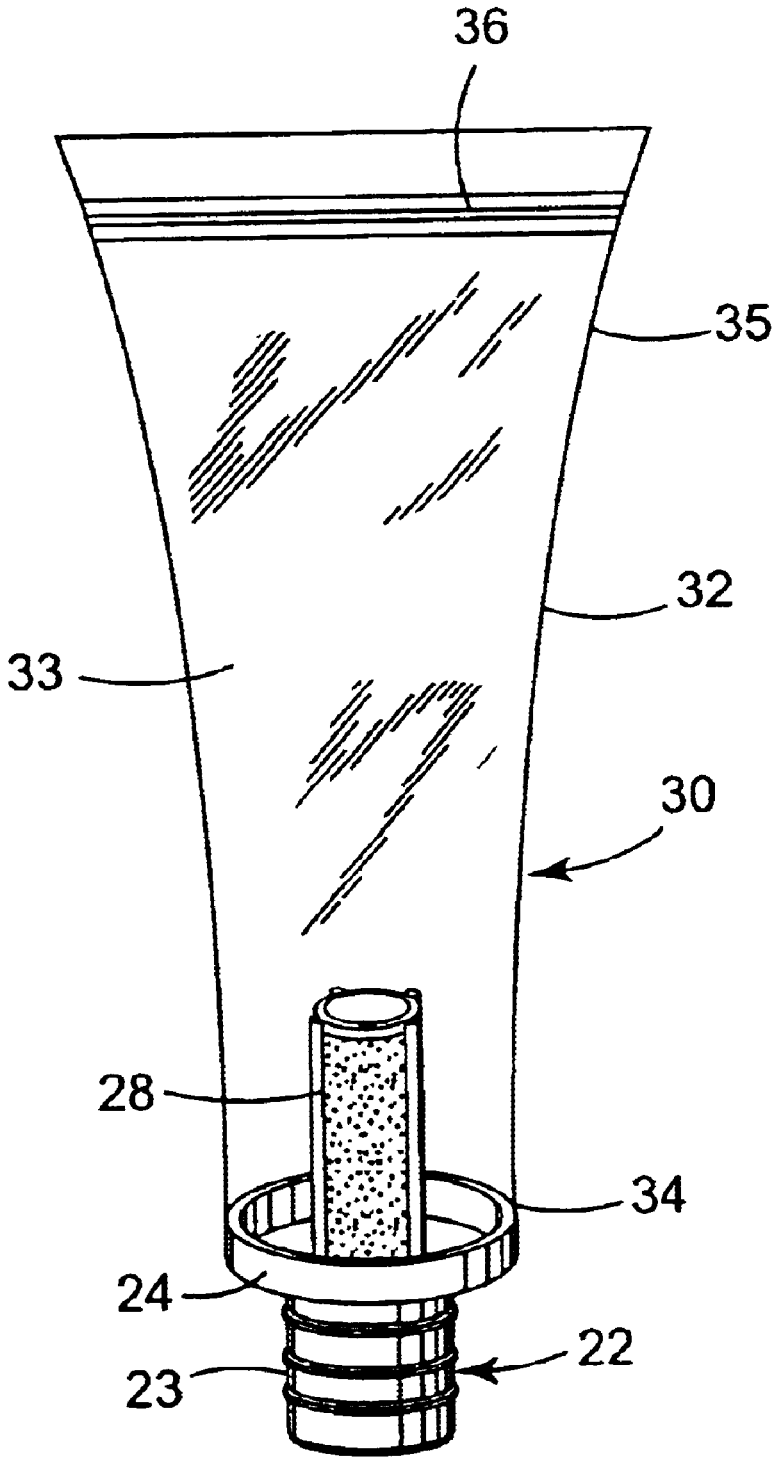
FIG. 3 is a perspective view of a second embodiment of a small volume container according to the present invention.

It is anticipated that the diameter and length of the body portion 18 could be varied significantly from those dimensions to provide a wide variety of volumes for the container 10, and that the novel structure for the container could be useful for purposes other than providing a small volume container for the purposes described herein. Hook members like the hook members 69 described and illustrated in U.S. patent application Ser. No. 90/901,410 could optionally be used on opposite sides of the engagement portion 23 of the first adapter 22 to provide a more secure engagement between the first adapter 22 and the reusable adapter 14. While such hook members are not usually necessary with several of the types of small volume containers described in this application, they might be useful for larger volume containers having the structure described above. Referring now to FIG. 3 there is illustrated a second embodiment of a small volume container 30 according to the present invention that can be used to feed liquid to the gravity feed liquid spraying device 12 through the reusable metal adapter 14. The container 30 includes a first adapter 22 and a filter assembly 28 having the same structures described above. The container 30 differs from the container 10 by the structure of an elongate generally tubular body portion 32 of the container 30, and the means for closing its second end 35. That body portion 32 is formed of thin, very flexible, transparent, paint solvent resistant polymeric film material (e.g., the heat sealable film commercially available from Minnesota Mining and Manufacturing Company (3M), St. Paul, Minn. under the trade designation ET29905 "SCOTCHPAK (T.M.) Film"). The body portion 32 has axially spaced first and second ends 34 and 35. The first end 34 of the body portion 32 is attached (i.e., by heat sealing) around the cylindrical lip 24 on the first adapter 22. The means for closing the second end 35 of the body portion 32 is in the form of a fastener 36 releasably attaching together opposed surfaces of the body portion 32 at the second end 35 of the body portion 32. The inner surfaces of the body portion 32, first adapter 22, and fastener 36 define a cavity 33 in the container 30. The fastener 36 is of the type commonly used on polymeric bags used to store food items which includes a longitudinal rib on one surface of the body portion 32, and two parallel projections on the other surface adapted to receive the rib in liquid tight engagement there between when the rib is pressed between those projections. The fastener 36 can be manually opened so that the container 30 can be filled with liquid through the second end 35 of the body portion 32, which could be done after the container 30 is mounted on the spraying device, or, by use of the plug 29 (see FIG. 2*b*) to close the engagement portion 23, could be done before the container 30 is mounted on the spraying device 12. The body portion 32 is collapsible as liquid in the container 30 moves through the opening in the first adapter 22 into the spraying device 12, thereby providing the container 30 with vacuum restricting means for allowing liquid within its cavity 21 to move through the through opening in the first adapter 22 with the second end 20 of the container 10 uppermost without causing a vacuum in the cavity 21 that could restrict the proper flow of liquid from the container 30 into the gravity feed spraying device 12.

As a non-limiting example, the body portion 32 of the container 30 can have a diameter of about 1.2 inches or 3 cm, and a length of about 5.5 inches or 14 cm between its ends 34 and 35 to provide a maximum volume for the cavity 21 of about 2.3 ounces or 70 ml. As another example with a slightly larger volume, the body portion 32 of the container 30 can have a diameter of about 1.8 inches or 4.6 cm, and a length of about 4.8 inches or 12 cm between its ends 34 and 35 to provide a maximum volume for the cavity 21 of about 4.5 ounces or 135 ml.

Figure 4:
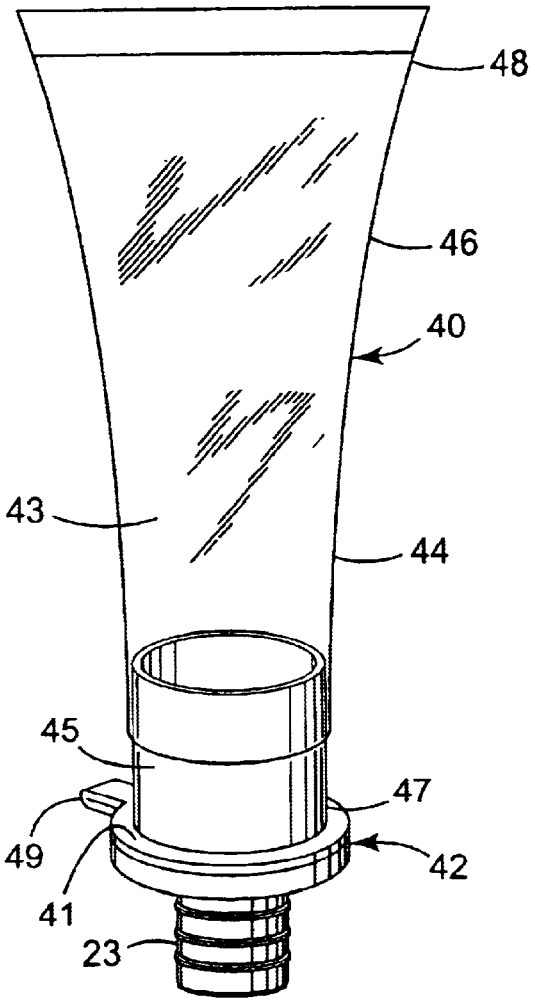
FIG. 4 is a perspective view of a third embodiment of a small volume container according to the present invention with a cap included in the container in a closed position.
Figure 5:
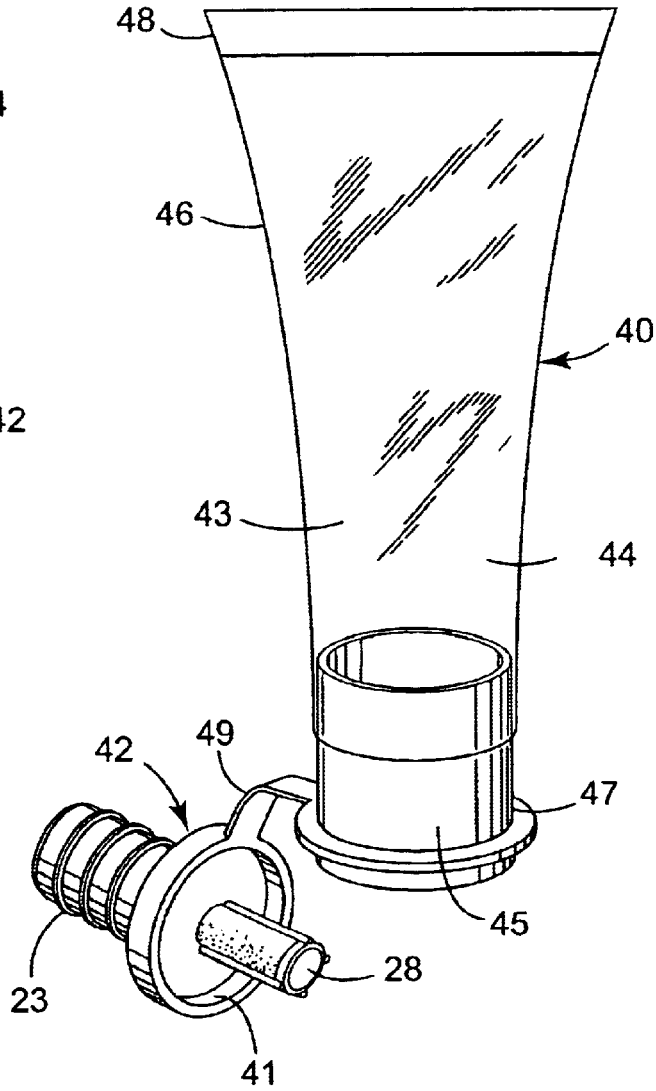
FIG. 5 is a perspective view of the small volume container of FIG. 4 with the cap included in the container in an open position.

Referring now to FIGS. 4 and 5 there is illustrated a third embodiment of a small volume container 40 according to the present invention that can be used to feed liquid to the gravity feed liquid spraying device 12 through the reusable metal adapter 14. The container 40 includes a first adapter 42 including an axially projecting engagement portion 23 and (optionally) a filter assembly 28 having the same structures indicated above. The container 40 differs from the container 10 in that (1) the adapter 42 includes an annular cap-like portion around the engagement portion 23, which cap-like portion includes a generally cylindrical axially projecting flange 41 around its periphery and (2) by the structure of an elongate generally tubular body portion 44 of the container 40. That body portion 44 has first and second axially spaced ends 47 and 48, and has an inner surface that with the inner surfaces of the first adapter 42 and means for closing the second end 48 of the body portion forms a cavity 43 in the container 40. Part of that body portion 44 is formed by a short stiff polymeric tube 45 open at both ends with one end being adapted for releasable sealing engagement within the flange 41 on the cap-like portion of the first adapter 42; whereas another part of that body portion 44 is formed by a tubular piece 46 of thin, very flexible, transparent, paint solvent resistant polymeric film material (e.g., the heat sealable film commercially available from Minnesota Mining and Manufacturing Company (3M), St. Paul, Minn. under the trade designation ET29905 "SCOTCHPAK (T.M.) Film"). The tubular piece 46 of polymeric film material has one end attached (i.e., by heat sealing) around the periphery of the tube 45, and its end opposite the tube 14 heat sealed shut to provide the means for closing the second end 48 of the body portion 44. The cap-like portion of the adapter 42 and the polymeric tube 45 can be made by modifying the container commercially available from Dow Corning Corp. under the trade designation "Snap-Seal" (trade mark) No. 1730. The cap-like portion of the adapter 42 is attached to the polymeric tube 45 by what is sometimes called a living hinge 49 so that the adapter 42 can be removed and pivoted away from the end of the tube 45 (see FIG. 5) and the container 40 can then be filled with liquid through the first end 47 of the body portion 44, which could be done before or after the engagement portion 23 of the adapter 42 is engaged with the reusable adapter 14 on the spraying device 12. The part 46 of the body portion 44 formed by the thin flexible polymeric film material will collapse as liquid in the container 40 moves through the openings in the first adapter 42 and the reusable adapter 14 into the spraying device 12, thereby providing for the container 40 vacuum restricting means for allowing liquid within its cavity 43 to move through the through opening in the first adapter 42 with the second end 48 of the container 40 uppermost without causing a vacuum in the cavity 43 that could restrict the proper flow of liquid from the container 40 into the gravity feed spraying device 12.

As a non-limiting example, the body portion 44 of the container 40 can have a diameter of about 1.2 inches or 3 cm, and a length of about 5.5 inches or 14 cm between its ends 47 and 48 to provide a maximum volume for the cavity 43 of about 2.3 ounces or 70 ml. Alternatively, the body portion 44 of the container 40 can have a diameter of about 1.9 inches or 4.8 cm, and a length of about 4.75 inches or 12 cm between its ends 47 and 48 to provide a maximum volume for the cavity 43 of about 5 ounces or 148 ml.

Figure 6:
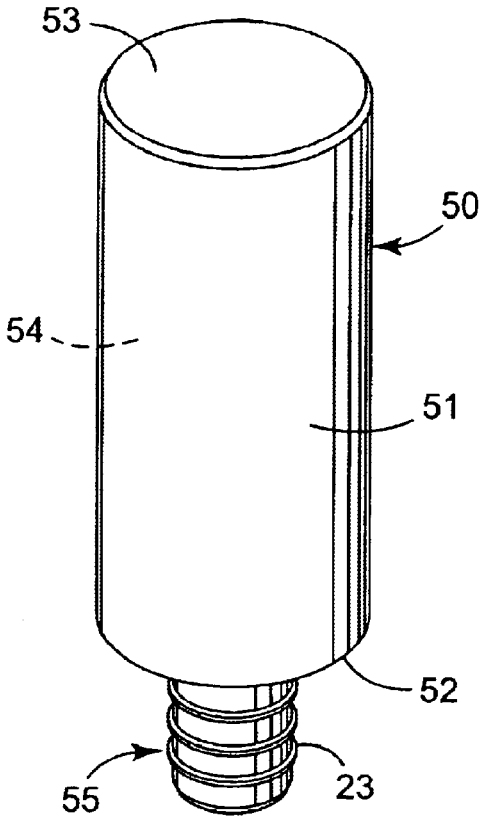
FIG. 6 is a perspective view of a fourth embodiment of a small volume container according to the present invention shown in its normal expanded condition.
Figure 7:
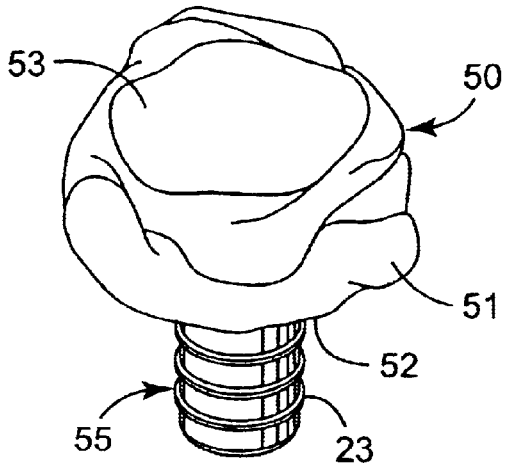
FIG. 7 is a perspective view of the small volume container of FIG. 6 shown in a collapsed condition in which it can be positioned.

Referring now to FIGS. 6 and 7 of the drawing there is illustrated a fourth embodiment of a small volume container 50 according to the present invention that can be used to feed liquid to the gravity feed spraying device 12 through the reusable adapter 14. The container 50 comprises a molded elongate tubular or cylindrical body portion 51 having a first end wall 52 included in a first adapter 55 for the container 50, and means for closing the second end of the body portion 51 in the form of a axially spaced second end wall 53. The body portion 51, first adapter 55 and second end wall 53 have inner surfaces defining a cavity 54 for the container 50. The container 50 is integrally molded of a stiff resiliently flexible polymeric material (e.g., 0.011 to 0.018 inch or 0.03 to 0.05 cm thick low density polyethylene), so that when the container 50 is collapsed by application of a generally transverse and/or axially directed outside force (which can be applied manually) and the force is then released, the container 50 will return to its original shape either by itself or with a small amount of manual manipulation. The first adapter 55 for the container 50 includes an axially projecting engagement portion 23 and (optionally) a filter assembly 28 (not shown) having the same structures indicated above that are centrally mounted on the first end wall 52. The paint filter assembly 28 is frictionally engaged with the inner surface of the engagement portion 23 after the container 50 is filled with liquid. The cavity 54 in the container 50 can be filled with liquid by manually collapsing the container 50, engaging the end portion 27*a* of the polymeric transfer pipette 27 described with reference to FIG. 2 with the inner surface of the engagement portion 23, immersing the distal end 27*b* of the transfer pipette 27 in the liquid, and allowing the container 50 to return to its original shape so that its cavity 54 expands in volume, causing atmospheric pressure to push liquid through the pipette 27 into the cavity 54 in the container 50. The pipette 27 is then removed and the engagement portion 23 of the first adapter 55 can then be manually pressed into the passageway 15 in the reusable adapter 14 with the spraying device 12 inverted, after which the spraying device 12 can be moved to its normal position with the body portion 51 projecting above the spraying device 12 with its second end wall 53 uppermost. As liquid from the container 50 is dispensed through the spraying device 12, the body portion 51 will again collapse to decrease the volume of the cavity 54. This ability of the cavity 54 in the container 50 to decrease in volume restricts formation of a vacuum in the cavity 54 as liquid within the cavity 54 moves through the through opening in the first adapter 55 into the gravity feed spraying device 12 with the second end wall 53 of the container 50 uppermost.

As a non-limiting example, the cylindrical body portion 51 of the container 50 can have a diameter of about 1.65 inches or 4.2 cm, and a length of about 3 inches or 7.6 cm between its end walls 52 and 53 to provide a maximum volume for the cavity 54 of about 2.5 ounces or 75 ml.

Figure 8:
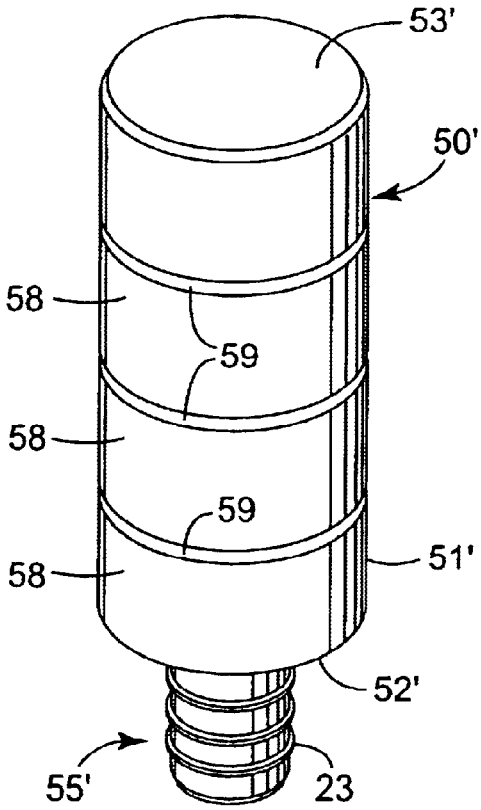
FIG. 8 is a perspective view of a fifth embodiment of a small volume container according to the present invention.

Referring now to FIG. 8 of the drawing there is illustrated a fifth embodiment of a small volume container 50' according to the present invention that can be used to feed liquid to the gravity feed spraying device 12 through the reusable adapter 14. The container 50' can be used in the same way as the container 50 described above (the similar parts thereof being identified by the same reference numerals to which has been added an apostrophe) and differs from the container 50 in that instead of its body portion 51' being totally cylindrical, its body portion 51' has axially spaced cylindrical portions 58 with annular axially spaced recesses 59 there between to cause bending of the body portion 51' at or between the recesses 59 to collapse the container 51' as the second end wall 53' of the body portion 51' is moved axially toward the first end 52' of the body portion 51'.

Figure 9:
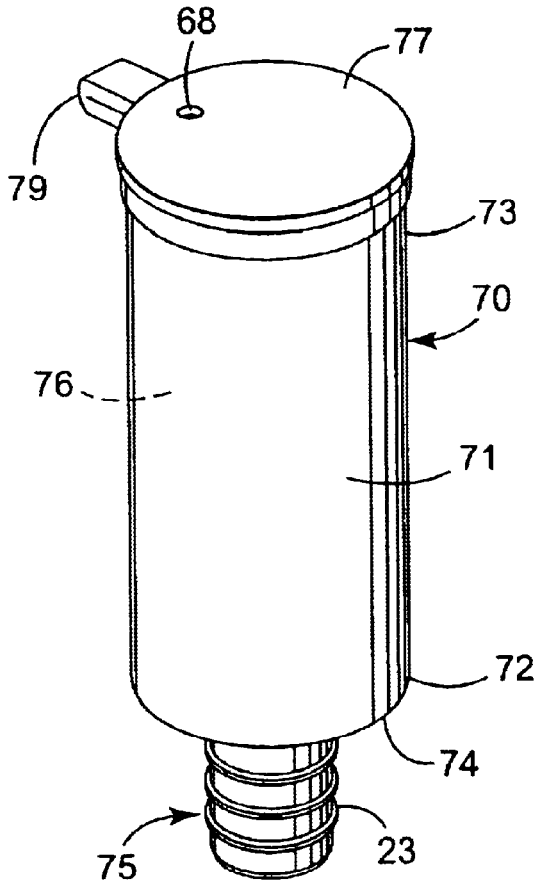
FIG. 9 is a perspective view of a sixth embodiment of a small volume container according to the present invention with a cap included in the container in a closed position.
Figure 10:
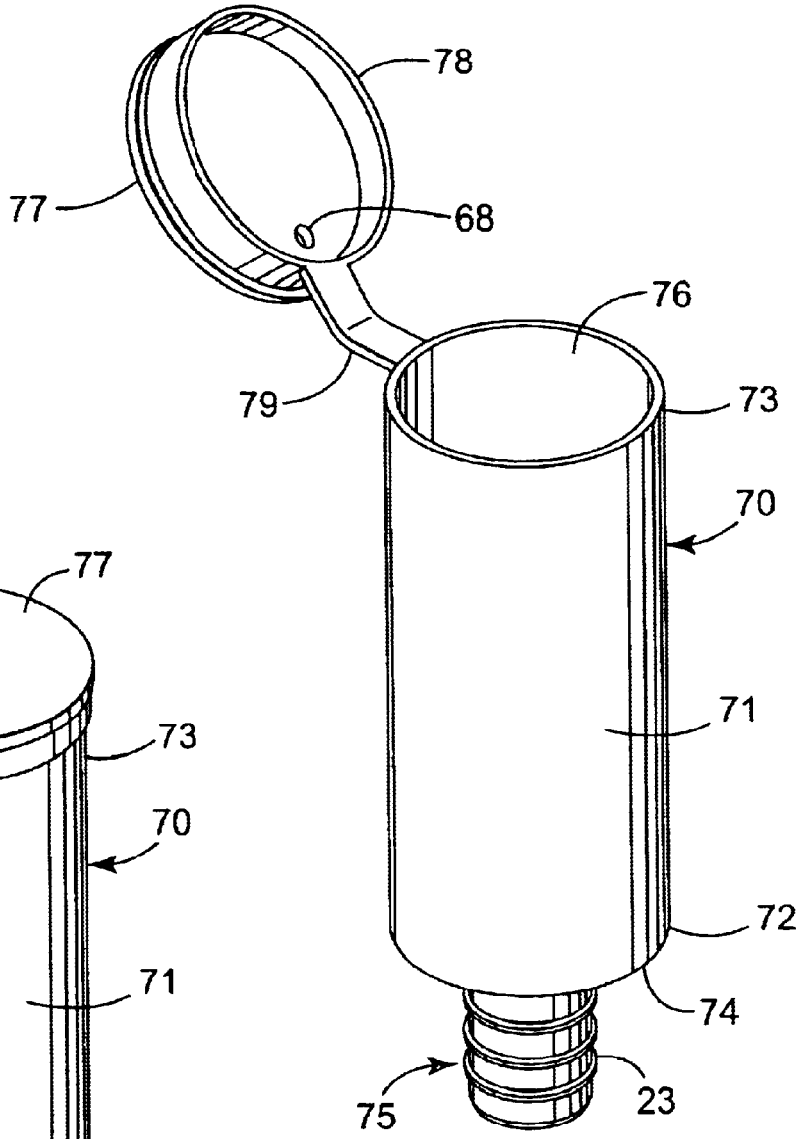
FIG. 10 is a perspective view of the small volume container of FIG. 9 with the cap included in the container in an open position.

Referring now to FIGS. 9 and 10 of the drawing there is illustrated a sixth embodiment of a small volume container 70 according to the present invention that can be used to feed liquid to the gravity feed spraying device 12 through the reusable adapter 14. The container 70 comprises a stiff polymeric molding including an elongate cylindrically body portion 71 having first and second ends 72 and 73, and a first end wall 74 fixed at the first end 72 of the body portion 71 (included in a first adapter 75 for the container 70) on which first end wall 74 is centrally fixed an axially projecting engagement portion 23 and (optionally) a filter 28 (not shown) having the same structures described above. The container 70 also includes a cap 77 at its second end 73, which cap 77, when closed, receives an end of the body portion 71 within a generally cylindrical axially projecting flange 78 around its periphery to provide means for closing the second end 73 of the body portion 71. The container 70 can be made by modifying the bottom wall of either the about 1.5 ounce or 40 ml container sold by Dow Corning Corp. under the trade designation "Snap-Seal" (trade mark) No. 1720, or the about 4 ounce or 118 ml container sold by Dow Corning Corp. under the trade designation "Snap-Seal" (trade mark) No. 1730. Inner surfaces of the body portion 71, adapter 75 and cap 77 define a cavity 76 for the container 70. The cap 77 is attached to the cylindrical body portion 71 by what is sometimes called a living hinge 79 so that the cap 77 can be removed and pivoted away from the cylindrical portion 71 (see FIG. 10) so that the cavity 76 in the container 70 can be filled with liquid through the second end 73 of the body portion 71. The cavity 76 in the container 70 can be filled with liquid either by using the plug 29 (see FIG. 2*b*) to close the engagement portion 23 before the container 30 is mounted on the spraying device 12, or by manually pressing the engagement portion 23 of the container 70 into the passageway 15 in the reusable adapter 14 with the spraying device 12 in its normal position so that the body portion 71 projects above the spraying device 12 with its second end 73 uppermost. The cap 77 is opened, the liquid poured into the cavity 76, and the cap 77 is closed. The cap 77 has a vent opening 68 to provide for the container 70 vacuum restricting means for allowing liquid within its cavity 72 to move through the through opening in the first adapter 75 with the second end 73 of the container 70 uppermost without causing a significant vacuum in the cavity 72 that could restrict the proper flow of liquid from the container 70 into the gravity feed spraying device 12.

Alternatively, instead of pre-forming the vent opening 68 in the cap 77, a vent opening can be formed in the cap 77 by the operator of the spraying device 12 when desired using a tapered pointed pin or push pin of the type often used to attach documents to bulletin boards in the manner described in U.S. patent application Ser. No. 09/374,794 filed Aug. 16, 1999, or the equivalent International Publication Number WO 01/12337 A1 published Feb. 22, 2001, the content of which application and publication are hereby incorporated herein by reference. Such use of a push pin together with use of the plug 29 illustrated in FIG. 2*b* facilitates using the container 70 for at least temporary storage of liquids to be sprayed.

Figure 11:
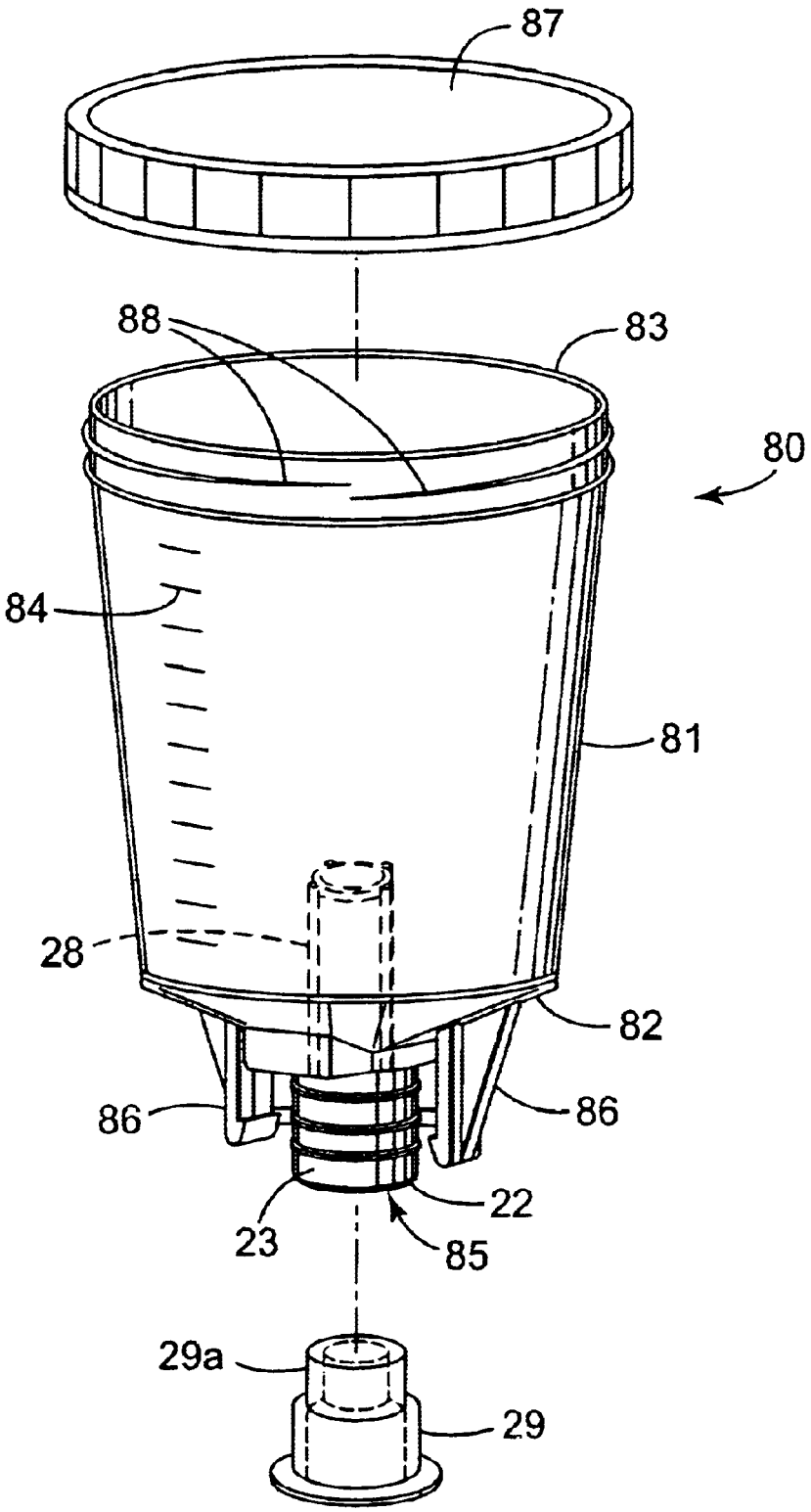
FIG. 11 is a perspective view of a seventh embodiment of a small volume container according to the present invention together with the plug of FIG. 2*b*.

Referring now to FIG. 11 of the drawing there is illustrated a seventh embodiment of a small volume container 80 according to the present invention that can be used to feed liquid to the gravity feed spraying device. 12 through the reusable adapter 14. The container 80 comprises a stiff polymeric injection molding (e.g., of polyethylene) including a frusto conical body portion 81 having first and second ends 82 and 83, and a first end wall fixed at the first end 82 of the body portion 81 (included in a first adapter 85 for the container 80) on which first end wall is centrally fixed an axially projecting engagement portion 23. Opposed hook members 86 like the hook members 69 described and illustrated in U.S. patent application Ser. No. 90/901,410 can optionally be fixed and spaced on opposite sides of the engagement portion 23 of the first adapter 22 to provide more secure engagement between the first adapter 85 and the reusable adapter 14. The container 80 can be made by modifying the bottom wall of the about 4 ounce or 118 ml container No. 8889-207026 sold by Oxford Lab Ware, St. Louis, Mo. Also, optionally, the container can include a filter 28 having the same structure described above, which filter 28 can have an end portion frictionally engaged with the inner surface of the engagement portion 23. Indicia 84 indicating the volume of the container 80 at several levels can be molded into the body portion 81. The container 80 also includes a cap 87 adapted to releasably engage the body portion 81 by threads 88 around the body portion 81 adjacent its second end 83 and around the inner surface of a generally cylindrical axially projecting flange on the cap 87 so that the cap 87 and threads 88 provide means for closing the second end 83 of the body portion 81. Inner surfaces of the body portion 81, adapter 85 and cap 87 define a cavity for the container 80. The cap 87 can be unscrewed from the body portion 81 and removed so that the cavity in the container 80 can be filled with liquid through the second end 83 of the body portion 81. The cavity in the container 80 can be filled with liquid either (1) after manually pressing the engagement portion 23 of the container 80 into the passageway 15 in the reusable adapter 14 with the spraying device 12 in its normal position, or (2), with the container 80 separated from the adapter 14, if the plug 29 (see FIG. 2*b* and the related description) is pressed into the engagement portion 23. Liquid can be mixed in the cavity using a mixing stick or the like, and/or the cap 87 can be closed, and (if the engagement portion 23 is closed by the plug 29) the container 80 can be shaken to mix liquid in the container 80. After the container 80 is engaged with the reusable adapter 14 of the spraying device 12 the cap 87 can be unscrewed slightly from its fully closed position, thereby providing a space between the cap 87 and the second end 83 of the body portion 81 that provides vacuum restricting means for allowing liquid within its cavity 82 to move through the through opening in the first adapter 85 with the second end 83 of the container 80 uppermost without causing a significant vacuum in the cavity 82 that could restrict the proper flow of liquid from the container 80 into the gravity feed spraying device 12. Engagement of the hook members 86 with the reusable metal adapter 14 (see FIG. 1) restricts rotation of the body portion 81 of the container 80 relative to the spraying device 12, thereby facilitating unscrewing the cap 87 with one hand while the spraying device 12 is being held by the other hand. If not all of the liquid in the container 80 is used, the cap 87 can be tightened, the container 80 can be removed from the spraying device 12, and the plug 29 can be inserted in the engagement portion 23, thereby allowing the liquid to be stored in the container 80 until it is again needed.

Alternatively, instead of loosening the cap 87, a vent opening can be formed in the cap 87 by the operator of the spraying device 12 when desired using a tapered pointed pin or push pin of the type often used to attach documents to bulletin boards in the manner described in U.S. patent application Ser. No. 09/374,794 filed Aug. 16, 1999, or the equivalent International Publication Number WO 01/12337 A1 published Feb. 22, 2001, the content of which application and publication are hereby incorporated herein by reference.

Figure 12:
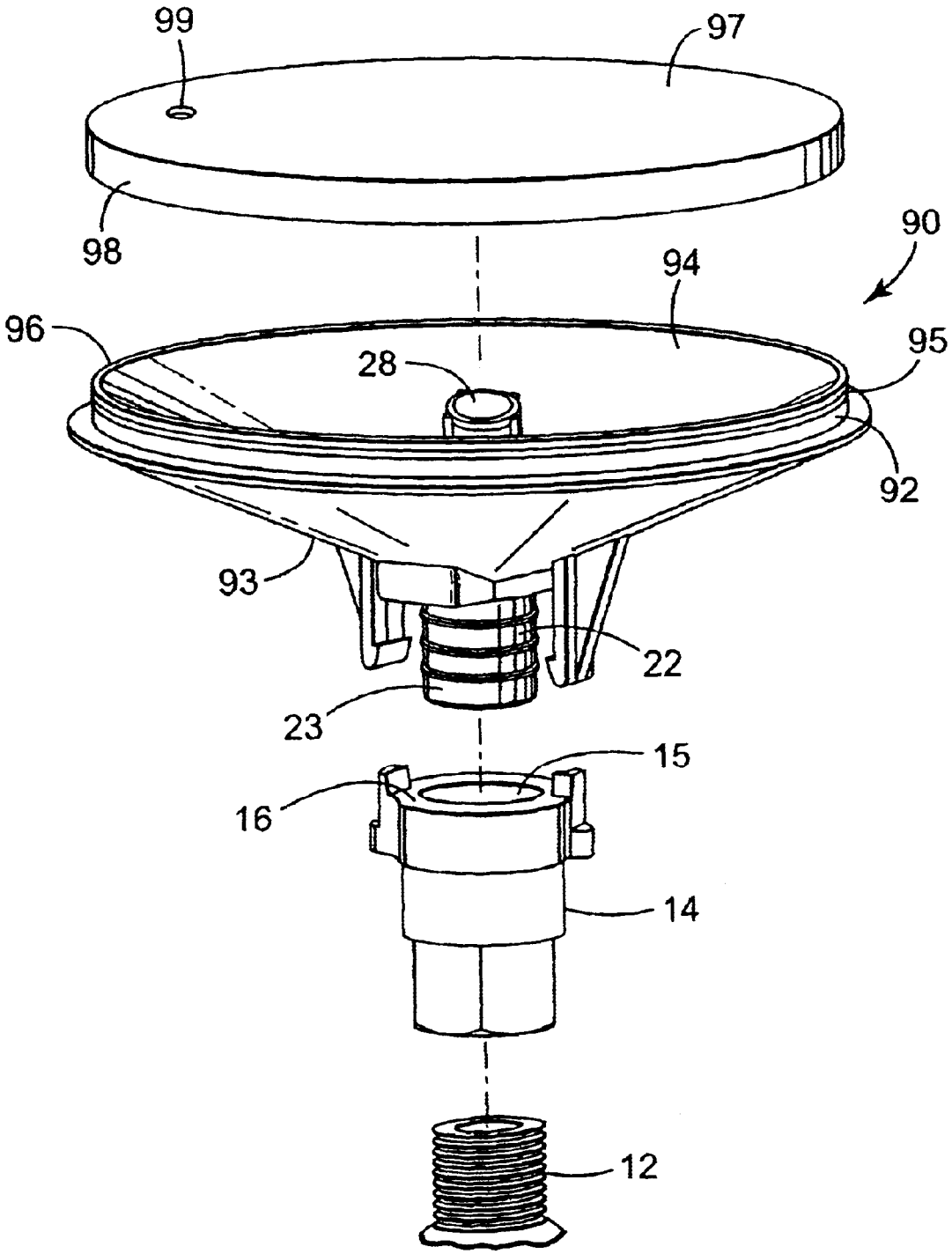
FIG. 12 is a perspective view of an eighth embodiment of a small volume container according to the present invention together with a second adapter with which it can be engaged and a fragment of a spraying device on which the second adapter can be mounted.

Referring now to FIG. 12 of the drawing there is illustrated an eighth embodiment of a small volume container 90 according to the present invention that can be used to feed liquid to the gravity feed spraying device 12 through the reusable adapter 14. A body portion 92 and an adapter 93 for the container 90 are identical to a first adapter 40 described in U.S. patent application Ser. No. 90/901,410 (without the container 12, disposable liner 20 and sealing ring 53 described therein) including the peripheral part 50 of the adapter 40 described therein, which body portion 92, as discussed above with reference to that U.S. patent application Ser. No. 90/901,410, can contain a small amount of liquid to be sprayed in a cavity defined by its diverging frusto conical inner surface 94 and its peripheral part 95. The container 90 according to the present invention further including means for closing a second end 96 of its body portion defined by the distal end of its peripheral part 95, which means for closing is provided by a cover 97 (i.e., a polymeric cover 97 of the type used to close opened cans of coffee). The cover 97 has a generally cylindrical axially projecting flange 98 that releasably engages the ribbed outer surface of that peripheral part 95. The cover 97 has a through vent opening 99 into the cavity (which cavity is then also defined by the inner surface of the cover 97) to provide vacuum restricting means for allowing liquid within the cavity to move through the through openings in the first adapter 93 and the reusable adapter 14 with the second end 96 of the container 90 uppermost without causing a significant vacuum in the cavity that could restrict the proper flow of liquid from the container 90 into the gravity feed spraying device 12.

Alternatively, instead of pre-forming the vent opening 99 in the cover 97, a vent opening can be formed in the cover 97 by the operator of the spraying device 12 when desired using a tapered pointed pin or push pin in the manner described in U.S. patent application Ser. No. 09/374,794 filed Aug. 16, 1999, or the equivalent International Publication Number WO 01/12337 A1 published Feb. 22, 2001.

The plug 29 seen in FIG. 2*b* for closing the engagement portion 23 can be used with any of the containers described above so that the containers 10, 30, 40, 60, 60' and 80 can be used (at least temporarily) for storage of liquid, and the containers 70 and 90 can also be used for that purpose if their vent openings are not pre-formed but are formed by the operator using a tapered pin as described above.

The present invention has now been described with reference to several embodiments and modifications thereof. It will be apparent to those skilled in the art that many changes can be made in the embodiments described without departing from the scope of the present invention. For example, the shape of the adapter on any of the embodiments could be changed as desired to either directly engage the inlet port of a spraying device, or to engage a reusable adapter on the spraying device having a shape different than the reusable adapter 14 illustrated in FIG. 1. Thus, the scope of the present invention should not be limited to the structures and methods described in this application, but only by the structures and methods described by the language of the claims and the equivalents thereof.

What is claimed is:

1. A container for use with a gravity feed liquid spraying device having a liquid inlet port, said container comprising:

an elongate body portion formed of thin flexible polymeric material, said body portion having a central axis, and having axially spaced first and second ends;

means for closing the second end of said body portion;

a first adapter attached to said first end of said body portion, said body portion, means for closing, and first adapter having inner surfaces defining a cavity in said container, said first adapter comprising a engagement portion having a through opening communicating with the cavity in said container and being adapted for liquid and air tight engagement with the inlet port of the liquid spraying device; and a plurality of stiff rings fixed to and spaced axially along said body portion;

the container being capable of being filled with liquid by manually collapsing the body portion of the container between the rings, engaging one end portion of a transfer pipette with an inner surface of the engagement portion and immersing an opposite end portion of the transfer pipette in the liquid, and pulling the second end of the body portion away from the first end of the body portion to cause the cavity to expand in volume so that atmospheric pressure pushes liquid into the cavity in the container through the transfer pipette, and said body portion being collapsible between said rings to afford movement of said rings to positions closely adjacent each other to decrease the volume of said cavity in the container as liquid in the container moves through the opening in said first adapter with said second end of said container uppermost, thereby restricting formation of a vacuum in the cavity.

2. A container according to claim 1 wherein the liquid inlet port on the spraying device is provided by a reusable adapter with a distal end and a through passageway opening through said distal end for receiving liquid to be sprayed by the spraying device, which reusable adapter has a cylindrical inner surface of a predetermined diameter adjacent said distal end, and the engagement portion of said first adapter has an outer surface adapted for liquid and air tight engagement with the cylindrical inner surface of the reusable adapter.

3. A container according to claim 1 wherein said cavity in said container has a volume of less than about 2.3 fluid ounces or 70 ml.

4. A container for use with a gravity feed liquid spraying device having a liquid inlet port, said container comprising:

an elongate body portion comprising thin flexible polymeric material, said body portion having a central axis and axially spaced first and second ends;

means for closing the second end of said body portion; and a first adapter attached to said first end of said body portion;

said body portion, means for closing, and first adapter having inner surfaces defining a cavity in said container;

said first adapter comprising a engagement portion having a through opening communicating with the cavity in said container and being adapted for liquid and air-tight engagement with the inlet port of the liquid spraying device;

said container including means for opening said body portion at one of said ends to allow filling the cavity with liquid through the opened end of said body portion; and said thin flexible polymeric material of said body portion being collapsible as liquid in the container moves through the opening in said first adapter with said second end of said container uppermost to restrict formation of a vacuum in the cavity.

5. A container according to claim 4 wherein said means for opening said body portion at one of said ends to facilitate filling the cavity with liquid through the opened end of said body portion and said means for closing the second end of said body portion are both provided by a fastener releasably attaching together opposed inner surface portions of the body portion at said second end, said fastener including a longitudinal rib on one of said inner surface portions and two parallel projections on the other of said inner surface portions receiving the rib in liquid tight engagement there between; said rib being manually removable from between said projections to open the second end of said body portion and allow filling the cavity with liquid through said second end of said body portion.

6. A container according to claim 4 wherein said body portion comprising a stiff body part having an first end defining the first end of said body portion and an opposite second end, and a flexible body part formed by thin flexible polymeric material extending from the second end of said stiff body part and defining the second end of said body portion; and said first adapter includes a cap fixed to the end of said engagement portion adjacent said body portion, said cap having a groove releasably receiving the first end of said stiff body member in liquid tight engagement, said cap being separable from said stiff body part to provide said means for opening said body portion to allow filling the cavity with liquid through said first end of said body portion.

7. A container according to claim 4 wherein the liquid inlet port on the spraying device is provided by a reusable adapter with a distal end and a through passageway opening through said distal end for receiving liquid to be sprayed by the spraying device, which reusable adapter has a cylindrical inner surface of a predetermined diameter adjacent said distal end, and the engagement portion of said first adapter has an outer surface adapted for liquid and air tight engagement with the cylindrical inner surface of the reusable adapter.

8. A container according to claim 4 wherein said cavity in said container has a volume of less than about 2.8 fluid ounces or 80 ml.

9. A container for use with a gravity feed liquid spraying device having a liquid inlet port, said container comprising:

an elongate generally cylindrical body portion having a central axis, and having axially spaced first and second ends;

an end wall closing the second end of said body portion; and a first adapter attached to said first end of said body portion;

said body portion, end wall, and first adapter having inner surfaces defining a cavity in said container;

said first adapter comprising a engagement portion having a through opening communicating with the cavity in said container and being adapted for liquid and air tight engagement with the inlet port of the liquid spraying device; and said body portion being formed of stiff resiliently flexible polymeric material so that said container upon being collapsed by application of outside force and then released will return to its original shape, said container being capable of being filled with liquid by manually collapsing the container, engaging one end portion of a transfer pipette with an inner surface of the engagement portion and immersing an opposite end portion of the transfer pipette in the liquid, and allowing the container to return to its original shape, and said body portion of said container being collapsible as liquid in the container moves through the opening in said first adapter with said second end of said container uppermost to restrict formation of a vacuum in the cavity.

10. A container according to claim 9 wherein said generally cylindrical body portion has axially spaced annular recesses to cause bending of said body portion at or between said recesses to collapse said container when said second end of said body portion is moved axially toward the first end of said body portion.

11. A container according to claim 9 wherein the liquid inlet port on the spraying device is provided by a reusable adapter with a distal end and a through passageway opening through said distal end for receiving liquid to be sprayed by the spraying device, which reusable adapter has a cylindrical inner surface of a predetermined diameter adjacent said distal end, and the engagement portion of said first adapter has an outer surface adapted for liquid and air tight engagement with the cylindrical inner surface of the reusable adapter.

12. A container for use with a gravity feed liquid spraying device having an inlet port, said container comprising:

a body portion having a central axis, and having axially spaced first and second ends;

means for closing the second end of said body; and a first adapter attached to said first end of said body portion;

said body portion, means for closing, and first adapter having inner surfaces defining a cavity in said container;

said first adapter comprising a engagement portion having a through opening communicating with the cavity in said container and being adapted for liquid and air tight engagement with the inlet port of the liquid spraying device;

said body portion being formed of stiff polymeric material and having an annular lip at the second end of said body portion, and said means for closing the second end of said body portion is a cap releasably engaged with said body portion adjacent said second end, said cap being separable from said body portion to thereby open the second end of said body portion to facilitate filing the container with liquid through said second end of said body portion, and said container including means for providing a vent opening into said chamber to restrict forming a vacuum in the cavity as liquid within the cavity in said container moves through the through opening in said first adapter with said second end of said container uppermost.

13. A container according to claim 12 wherein said body portion is elongate, and said cap for closing the second end of said body portion has a peripheral flange releasably receiving a part of said body adjacent said second end.

14. A container according to claim 12 wherein said inner surface defining the cavity comprises a frusto conical inner surface portion adjacent and diverging away from said engagement portion, and a cylindrical portion at the end of said frusto conical inner surface portion opposite said engagement portion, and said cap for closing the second end of said body portion has a cylindrical flange engaged around said body portion adjacent said second end.

15. A container according to claim 12 wherein the liquid inlet port on the spraying device is provided by a reusable adapter with a distal end and a through passageway opening through said distal end for receiving liquid to be sprayed by the spraying device, which reusable adapter has a cylindrical inner surface of a predetermined diameter adjacent said distal end, and an outer surface of the engagement portion of said first adapter is adapted for liquid and air tight engagement with the cylindrical inner surface of the reusable adapter.

16. A container according to claim 12 wherein said cavity in said container has a volume of less than about 2.3 fluid ounces or 70 ml.

17. A container according to claim 12 wherein said means for providing a vent opening into said chamber to restrict forming a vacuum in the cavity as liquid within the cavity in said container moves through the through opening in said first adapter with said second end of said container uppermost comprises a vent opening through said cap.

18. A container according to claim 12 wherein said body portion and said cap have threads releasably engaging said cap with said body portion, and said means for providing a vent opening into said chamber to restrict forming a vacuum in the cavity as liquid within the cavity in said container moves through the through opening in said first adapter with said second end of said container uppermost comprises the ability to manually loosen said cap with respect to said body portion.

* * * * *